US008049670B2

(12) United States Patent
Jung et al.

(10) Patent No.: US 8,049,670 B2
(45) Date of Patent: Nov. 1, 2011

(54) PORTABLE TERMINAL

(75) Inventors: Kang-Jae Jung, Seoul (KR); An-Sun Hyun, Seoul (KR); Chang-Won Yun, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 352 days.

(21) Appl. No.: 12/394,224

(22) Filed: Feb. 27, 2009

(65) Prior Publication Data

US 2009/0243944 A1 Oct. 1, 2009

(30) Foreign Application Priority Data

Mar. 25, 2008 (KR) ..... 10-2008-0027548

(51) Int. Cl.
*H01Q 1/24* (2006.01)

(52) U.S. Cl. ..... 343/702; 343/846

(58) Field of Classification Search ..... 381/312, 381/323, 322, 315, 60; 343/841, 702; 455/575.1, 455/575.7

See application file for complete search history.

(56) References Cited

U.S. PATENT DOCUMENTS

2005/0197014 A1* 9/2005 Kim et al. ..... 439/629
2007/0176833 A1* 8/2007 Haho et al. ..... 343/702

* cited by examiner

*Primary Examiner* — Hoanganh Le
(74) *Attorney, Agent, or Firm* — KED & Associates, LLP

(57) ABSTRACT

A portable terminal may include a terminal body, a printed circuit board having a ground unit coupled to an antenna, and an electric field reducing unit to transfer a current flowing in the ground unit to a side surface of the terminal body and to reduce strength of an electric field.

11 Claims, 5 Drawing Sheets

PORTABLE TERMINAL

The present application claims priority from Korean Application No. 10-2008-0027548, filed Mar. 25, 2008, the subject matter of which is incorporated herein by reference.

BACKGROUND

1. Field

Embodiments of the present invention may relate to a portable terminal having an electric field reducing unit to minimize or reduce interference between a portable terminal (or mobile terminal) and a hearing aid.

2. Background

A portable terminal is a portable device that is equipped with one or more functions such as a voice/video telephony call function, an information input/output function, a data storage function, etc. A portable terminal may include a mobile terminal (or a wireless terminal).

The portable terminal has incorporated various complicated functions, such as taking photos or videos, reproducing music files or video files, playing games, receiving broadcasts, etc. The portable terminal has also been implemented as an integrated multimedia device.

There is a concern about how electromagnetic waves generated by the portable terminal may affect a human body. In particular, there are concerns about interference between a user's hearing aid and the portable terminal. One concern is that electromagnetic waves generated by the portable terminal may cause malfunction of the hearing aid.

The Federal Communications Commission (FCC) has established rules for Hearing Aid Compatibility (HAC) such that manufacturers of hearing aids and wireless devices comply with HAC. This trend is becoming more worldwide.

Hearing Aid Compatibility (HAC) may refer to authentication and test items for compatibility that allows a hearing aid and a portable terminal to be simultaneously used without interference. Magnetic fields generated by the portable terminal may be sensed and amplified by a telecoil (T-coil) of the hearing aid, and then transferred to the user who wears the hearing aid in voice call signals. HAC has established measurement methods for a magnetic response of the hearing aid and reference (specified) values.

As one example of measurement methods for HAC, FIG. 1 illustrates measuring strength of an electric field generated at a periphery of a receiver of a portable terminal. More specifically FIG. 1 shows that a terminal body 10 includes a receiver 11 provided at one end of the terminal body 10. FIG. 1 also shows a measurement area 12 for measuring strength of generated electric waves is provided at a certain area based on the receiver 11.

The measurement area 12 may have a size of 5 cm×5 cm at a height of 1 cm from the terminal body 10. As shown in FIG. 1, the measurement area 12 may include 9 grids 13. A strength of electric fields formed in each of the grids 13 may be measured using a probe for measuring an electric field. Among 8 grids, except a grid 14 positioned at a central portion, 3 grids 13 having a greatest amount of electromagnetic waves may be excluded. A maximum value may be set among the grid 14 positioned at the central portion and the remaining 5 grids 13, so that this value may be less than a preset reference value.

Research has been done to reduce strength of electric fields formed at a periphery of a receiver to satisfy the above standard in designing and manufacturing portable terminals.

BRIEF DESCRIPTION OF THE DRAWINGS

Arrangements and embodiments may be described in detail with reference to the following drawings in which like reference numerals refer to like elements and wherein.

DETAILED DESCRIPTION

Embodiments of the present invention may minimize (or reduce) interference between a portable terminal and a hearing aid by reducing strength of an electric field formed at a periphery of a receiver of the portable terminal.

Exemplary embodiments of the portable terminal may be explained in detail with reference to the accompanying drawings.

Figure 2:
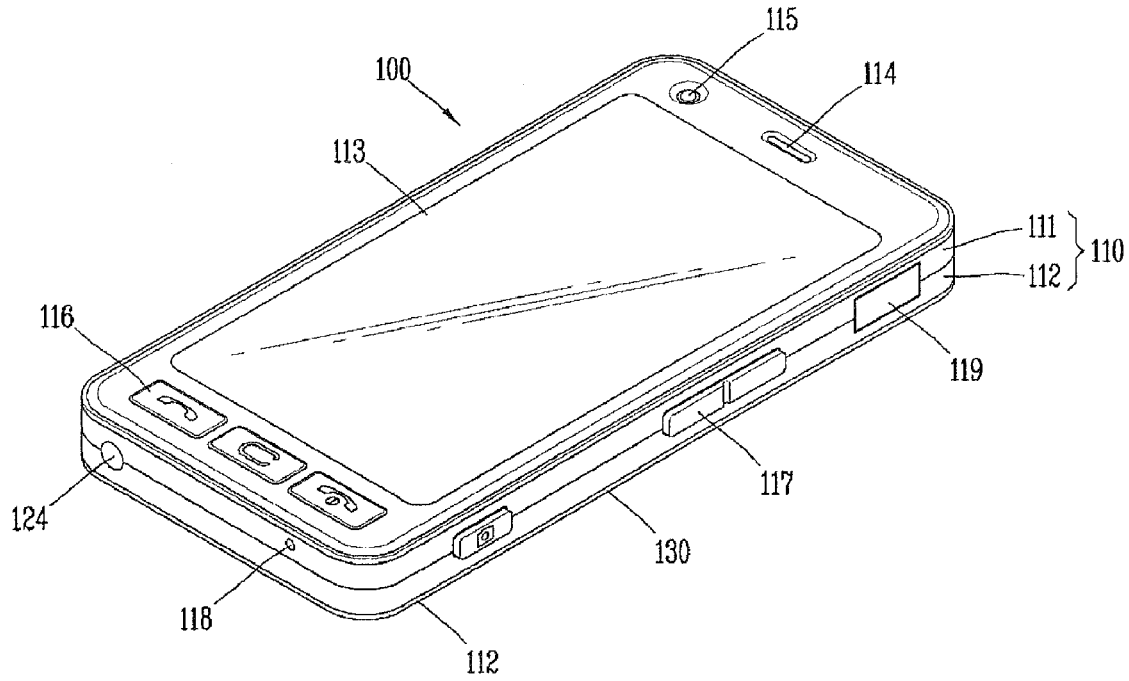
FIG. 2 is a front perspective view showing a portable terminal according to an example embodiment of the present invention.

FIG. 2 is a front perspective view showing a portable terminal according to an example embodiment of the present invention. Other embodiments and configurations are also within the scope of the present invention.

FIG. 2 shows a portable terminal 100 that may include a terminal body 110 forming an outer appearance.

A case (casing, housing, cover or the like) forming the outer appearance of the terminal body 110 may include a front case 111 and a rear case 112. Electronic components may be mounted within space formed between the front case 111 and the rear case 112.

At least one intermediate case may be provided between the front case 111 and the rear case 112.

The cases may be formed of an injection molded plastic, or may be formed using a metallic material (e.g., stainless steel (STS), titanium (Ti), or the like).

A display 113, a first audio output unit 114, a first image input unit 115, first and second manipulation units 116 and 117, an audio input unit 118, and an interface 119 may be provided on the terminal body 110.

The display 113 may include a Liquid Crystal Display (LCD) module, an Organic Light Emitting Diodes (OLED) module, or the like for providing a visual display of information.

The display 113 may further include a touch screen to generate an input of information upon being touched by a user (or based on a proximity touch). The display 113 may display visual information such as numbers, characters, symbols, etc. so as to enable inputting of a telephone number or the like, whereby a user may input information by touching the visual information displayed on the display 113.

The first audio output unit 114 may be a receiver or a speaker. The first audio output unit 114 may be provided at one end of the terminal body 110 corresponding to a position of a user's ear.

The first image input unit 115 may be a camera module to capture an image or a video of a user.

The first and second manipulation units 116, 117 may enable a user to input commands to control operations of the portable terminal 100. The first and second manipulation units 116, 117 may be referred to as a manipulation unit, and may also be implemented in any of various types such that it is capable of being operated in a tactile manner.

The manipulation unit may be implemented with a dome switch or touch pad that can receive user commands or information according to a user's pressing, pushing or touching, or may be implemented as a wheel that rotates a key, a jog element, a joystick, or the like.

The first manipulation unit 116 may be used for inputting commands, such as start, stop, scroll, etc. The second manipulation unit 117 may adjust a volume of an audio outputted from the first audio output unit 114 for activating and/or deactivating a touch recognition mode of the display 113 or the like.

The audio input unit 118 may be a microphone to transduce a user's voice, other sounds, or the like.

The interface 119 may be used as a link (passage or path) through which the portable terminal 100 may exchange data (or the like) with an external device. For example, the interface 119 may be implemented as one of a connection port for connecting an earphone to the portable terminal via a wired (fixed) or wireless means, a port for short-range communications (e.g., an Infrared Data Association (IrDA) port, a Bluetooth™ port, a wireless LAN port, etc.), power supply ports for providing power to the portable terminal, or the like.

The interface 119 may be a card socket for receiving an external card including a Subscriber Identification Module (SIM) card, a User Identity Module (UIM) card, and a memory card for information storage.

Figure 1:
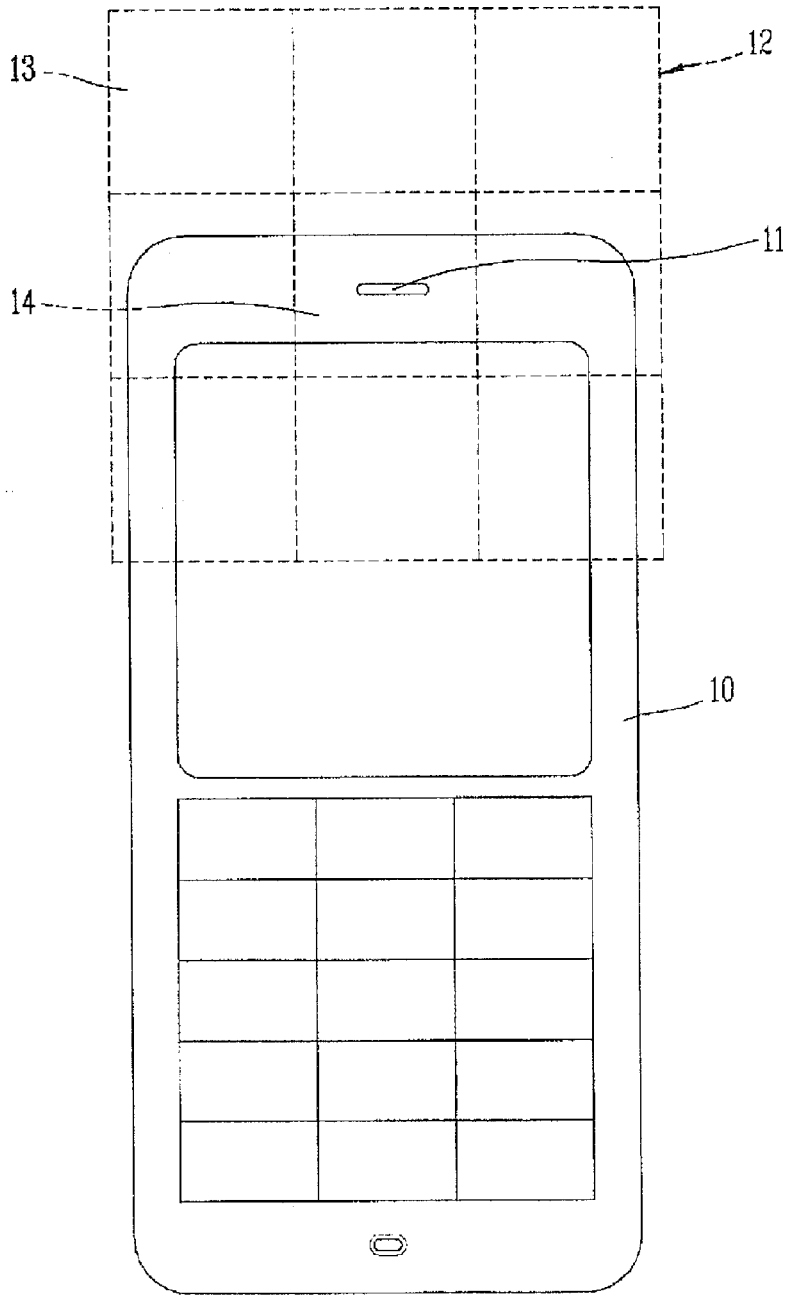
FIG. 1 is a view showing measuring strength of an electric field at a periphery of a portable terminal as defined in the Hearing Aid Compatibility.
Figure 3:
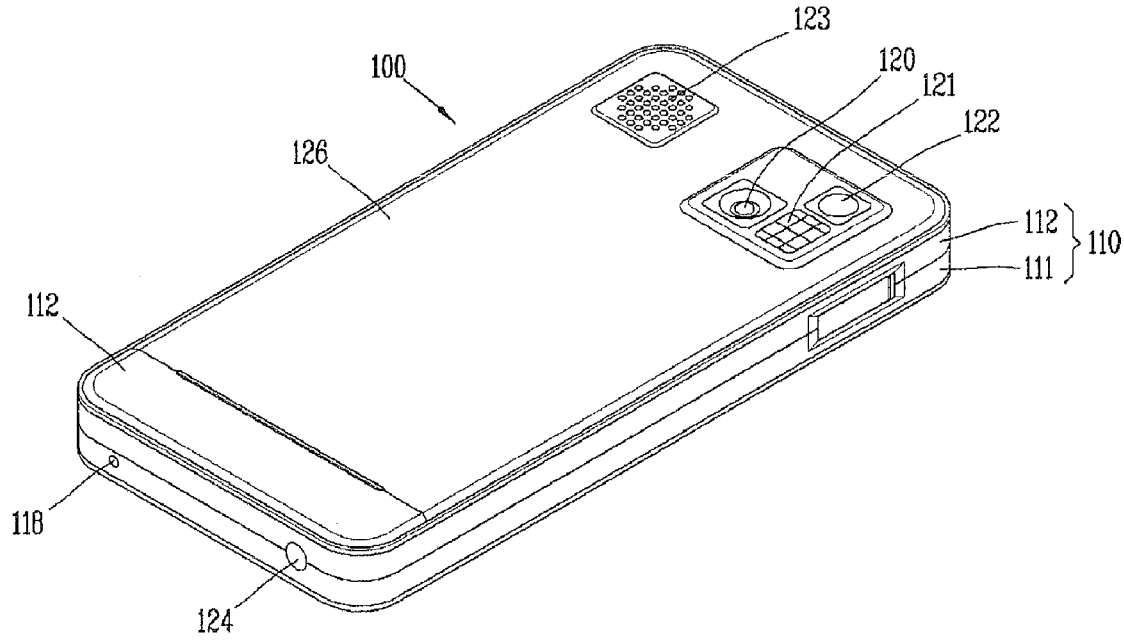
FIG. 3 is a rear perspective view showing a portable terminal according to an example embodiment of the present invention.

FIG. 3 is a rear perspective view showing the portable terminal in FIG. 2. More specifically, FIG. 3 shows a second image input unit 120 provided (or mounted) at a rear surface of the terminal body 110. The second image input unit 120 may have an image capture direction that is substantially opposite as the first image input unit 115 (FIG. 1), and the second image input unit 120 may be a camera supporting a different number of pixels as the first image input unit 115.

The first image input unit 115 may operate with a relatively lower resolution, as compared to the second image input unit 120, to capture a user's face and transmit the same to the other party during video call communication or the like, while the second image input unit 120 may operate with a relatively higher resolution to capture images of general subjects with high picture quality not for immediately being transmitted but for later use or for communicating to others.

A flash 121 and a mirror 122 may be provided adjacent to the second image input unit 120. When an image of a subject is to be captured with the second image input unit 120, the flash 121 may illuminate the subject. The mirror 122 may allow a user to see themselves when they want to capture their own image (self-image capturing) by using the second image input unit 120.

The rear surface of the terminal body 110 may further include a second audio output unit 123. The second audio output unit 123 may implement a stereophonic sound function in conjunction with the first audio output unit 114 (refer to FIG. 1) and may also be used for sending and receiving audio calls in a speaker phone mode.

Figure 8:
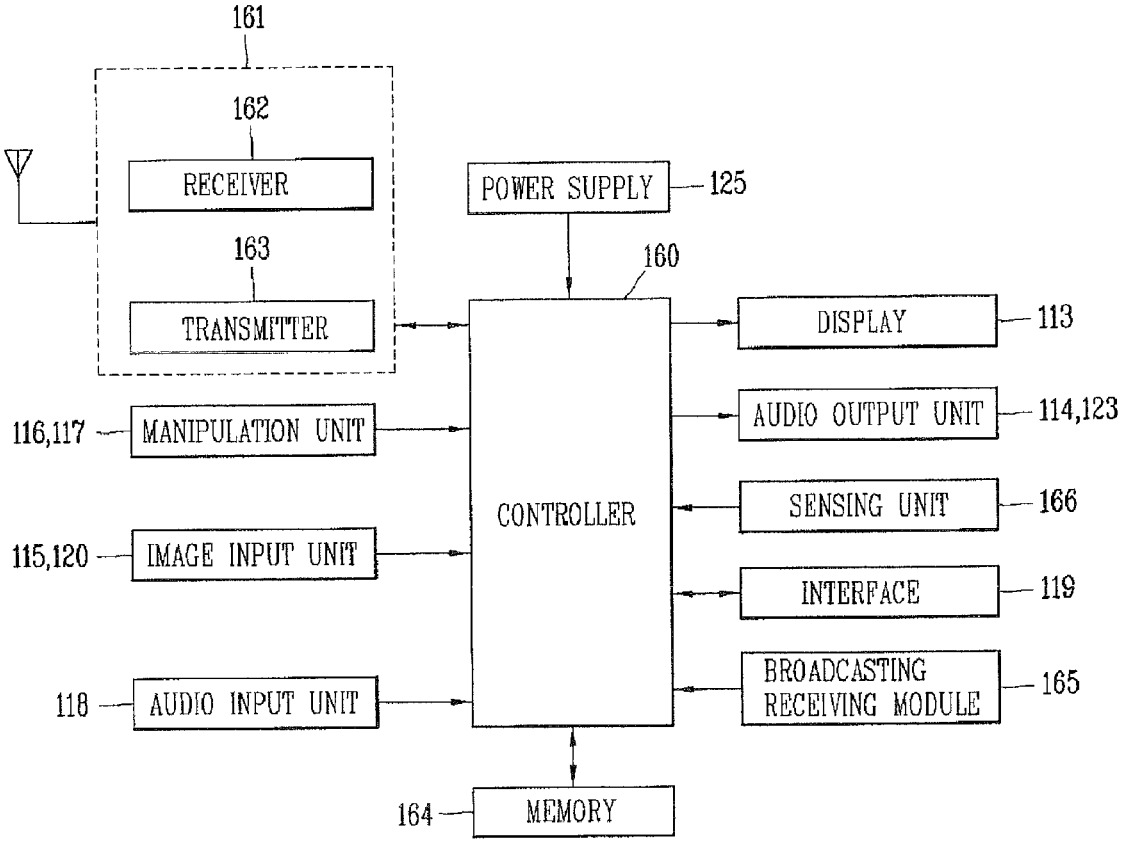
FIG. 8 is a block diagram showing a portable terminal according to an example embodiment of the present invention.

A power supply 125, shown in FIG. 8, may be located on the rear case 112 and supply power to the portable terminal 100. The power supply 125 may be a rechargeable battery that can be detached, for example. A battery cover 126 for covering the battery may be detachably provided at the rear case 112.

A broadcast signal receiving antenna 124 may be provided at one side or region of the terminal body 110 in addition to an antenna that supports mobile communications. The antenna 124 may be retractable from the terminal body 110.

Figure 4:
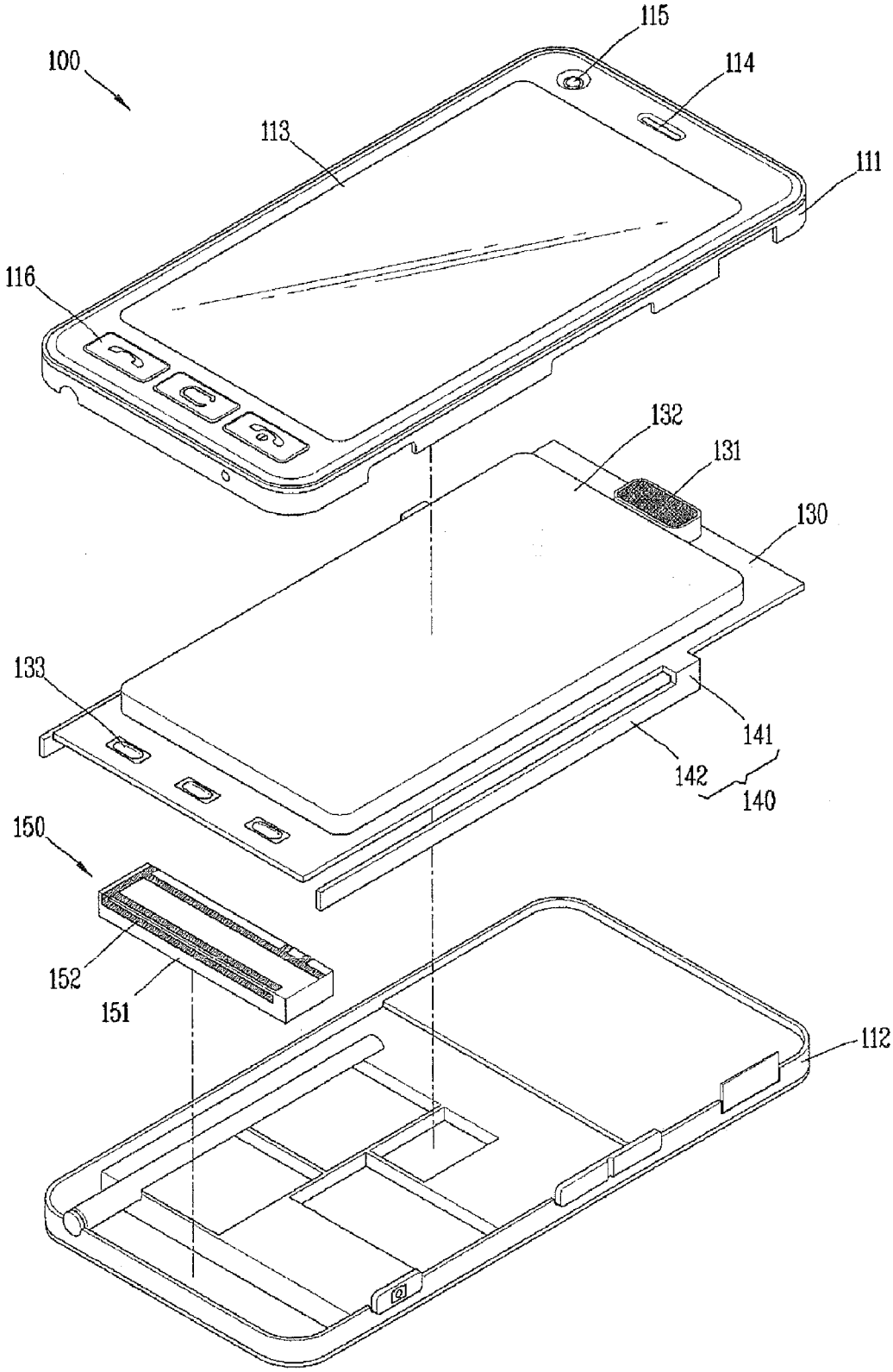
FIG. 4 is an exploded perspective view showing a portable terminal.

FIG. 4 is an exploded perspective view showing the portable terminal 100 in FIG. 2. More specifically, FIG. 4 shows a printed circuit board 130 provided between the front case 111 and the rear case 112. Electronic components for performing a variety of functions of the portable terminal 100 may be provided on the printed circuit board 130. The printed circuit board 30 may also be referred to as a ground unit.

A receiver 131, implemented as the audio output unit 114, may be provided (or mounted) at one end of the printed circuit board 130, and a display module 132 for outputting visual information may be provided (or mounted) at a lower side of the receiver 131. A switch 133 (or key) for applying a manipulation signal according to a user's push operation may be provided (or mounted) below the display module 132, such that it is implemented as the first manipulation unit 116. A plurality of switches or key may also be provided. The switches or keys may also be provided at other locations with respect to the display module 132.

Conductive circuit patterns may be provided on a surface of the printed circuit board 130 or inside the printed circuit board 130 to connect the electronic components mounted thereon.

An internal antenna 150 for transmitting/receiving wireless signals may be provided (or mounted) at one side of the printed circuit board 130 (i.e., at another end of the terminal body 110).

The internal antenna 150 may include a conductive emitter 151, a carrier 152 for mounting and supporting the conductive emitter 151, and the like.

The carrier 152 may be provided (or mounted) at a lower portion of the printed circuit board 130, and the emitter 151 may be patterned to be attached to one surface of the carrier 152. A feeding terminal for electrically connecting to the printed circuit board 130 may be formed at an end of the emitter 151.

The terminal body 110 may include a ground unit, implemented as the printed circuit board 130, for electrically connecting to the internal antenna 150. The internal antenna 150 may convert a received wireless signal into a form of a current and then feed the current to the printed circuit board 130. The current fed from the internal antenna 150 may flow on the printed circuit board 130.

An electric field reducing unit 140 may be formed on a side surface of the printed circuit board 130 to partially transfer a current flowing on the printed circuit board 130 to a side surface of the terminal body 110.

The electric field reducing unit 140 may reduce strength of an electric field formed at a periphery of the receiver 131. The electric field reducing unit 140 may be a branch type that extends from the side surface of the printed circuit board 130 and further extends in a direction away from the receiver 131. The electric field reducing unit 140 may be formed on both side surfaces of the printed circuit board 130. The electric field reducing unit 140 may also be formed on any one of the side surfaces of the printed circuit board 130.

The electric field reducing unit 140 may include a connecting portion 141 to connect to a side surface of the printed circuit board 130 at a location spaced a prescribed distance from the receiver 131, and an extending portion 142 to extend from the connecting portion 141 in an direction away from (or opposite) the receiver 131.

The connecting portion 141 may extend from the printed circuit board 130 in a direction of the front case 111 or the rear case 112 with a prescribed distance, and the extending portion 142 may be formed in a lengthwise direction parallel to the printed circuit board 130. The connecting portion 141 and the extending portion 142 may be integrally formed, and may also be formed of a conductive material to electrically connect to the printed circuit board 130. The connecting portion 141 and the extending portion 142 may be formed of the same material as the printed circuit board 130, but may be configured to dispose a conductive material therein.

Figure 5:
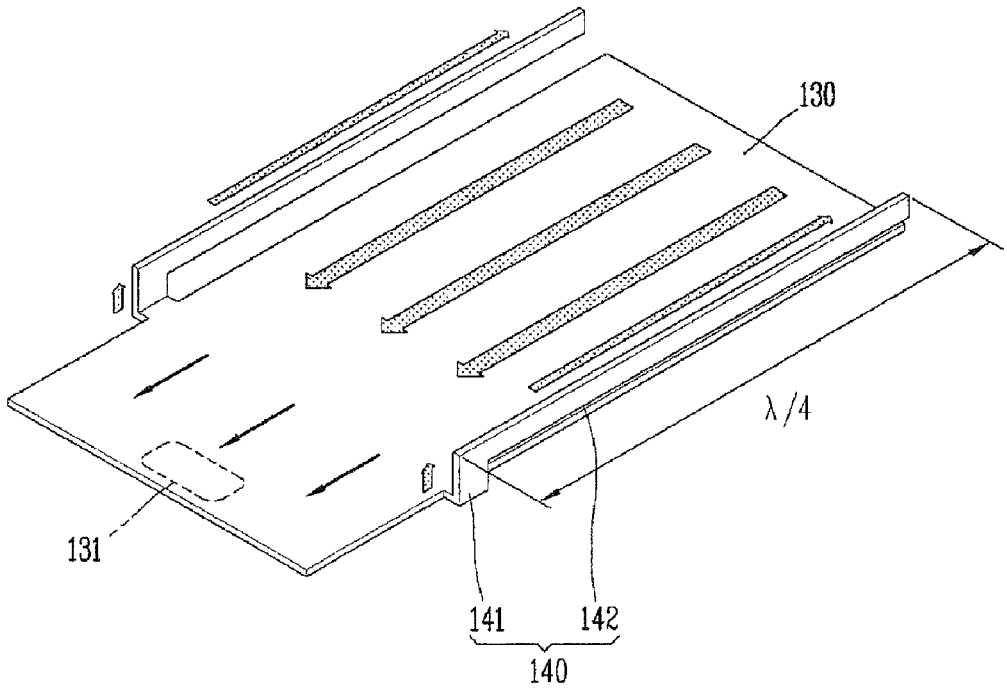
FIG. 5 is a rear perspective view showing a printed circuit board.
Figure 6:
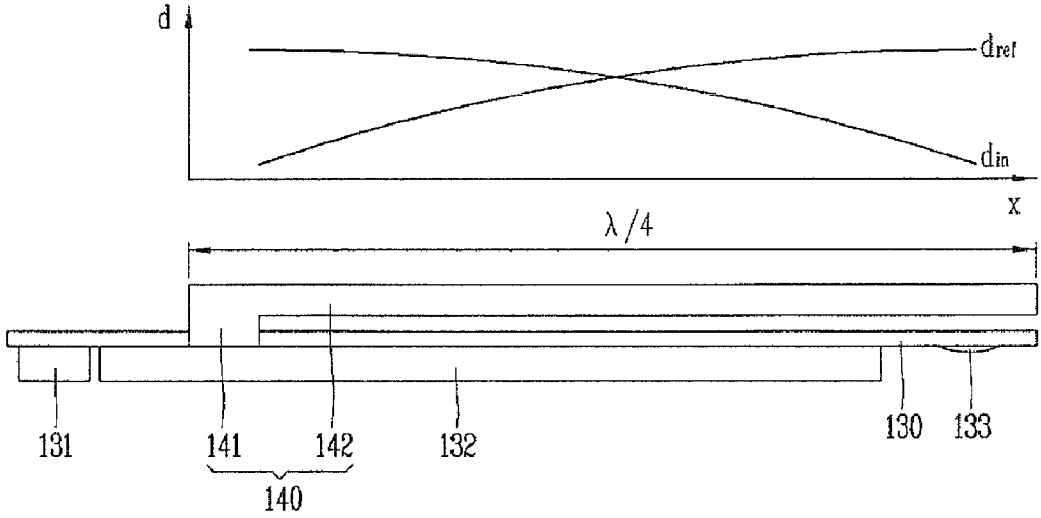
FIG. 6 is a side view showing a printed circuit board.

FIG. 5 is a rear perspective view showing the printed circuit board 130 of FIG. 4. FIG. 6 is a side view showing the printed circuit board 130 of FIG. 5. Arrows shown in FIG. 5 schematically indicate a flow of a current on the printed circuit board.

As shown in FIG. 5, current fed to the printed circuit board 130 by the internal antenna 150 may flow toward an end of the printed circuit board 130 where the receiver 131 is provided. If the current flowing on the printed circuit board 130 reaches an area where the electric field reducing unit 140 is provided, some of the current flows to and/or through the electric field reducing unit 140. The rest of the current, except current transferred to the electric field reducing unit 140, may flow to the receiver 131.

The electric field reducing unit 140 may transfer current that flows toward the receiver 131 on the printed circuit board 130 to a side surface of the printed circuit board 130, thereby reducing an amount of current reaching a periphery of the receiver 131. Therefore, since the electric field reducing unit 140 reduces the amount of the current flowing at the periphery of the receiver 131, strength of an electric field formed at the periphery of the receiver 131 is also reduced, thus decreasing damage to a hearing aid that may be affected by the electric field formed at the periphery of the portable terminal.

The electric field reducing unit 140 may have a length corresponding to ¼ times of a wavelength (λ hereinafter referred to as an antenna wavelength) of an electric wave that is transmitted/received to/from the internal antenna 150. The graph in FIG. 6 illustrates a relative size of an incident current density $d_{in}$ and a reflected current density $d_{ref}$ in a lengthwise direction of the electric field reducing unit 140.

The incident current density $d_{in}$ may become more reduced at an end of the electric field reducing unit 140 that is away from the receiver 131 (or in the opposite direction from the receiver 131). The reflected current density $d_{ref}$ may be more increased at the end of the electric field reducing unit 140. If the length of the electric field reducing unit 140 (i.e., a total length of the connecting portion 141 and the extending portion 142) becomes ¼ times of the antenna wavelength λ, each phase of the incident current density $d_{in}$ and the reflected current density $d_{ref}$ may be opposite. Accordingly, when the length of the electric field reducing unit 140 becomes ¼ times of the antenna wavelength λ, the amount of a current to be transferred from the printed circuit board 130 to the electric field reducing unit 140 may be maximized, and thus strength of the electric field formed at the periphery of the receiver 131 may be minimized (or reduced).

Figure 7:
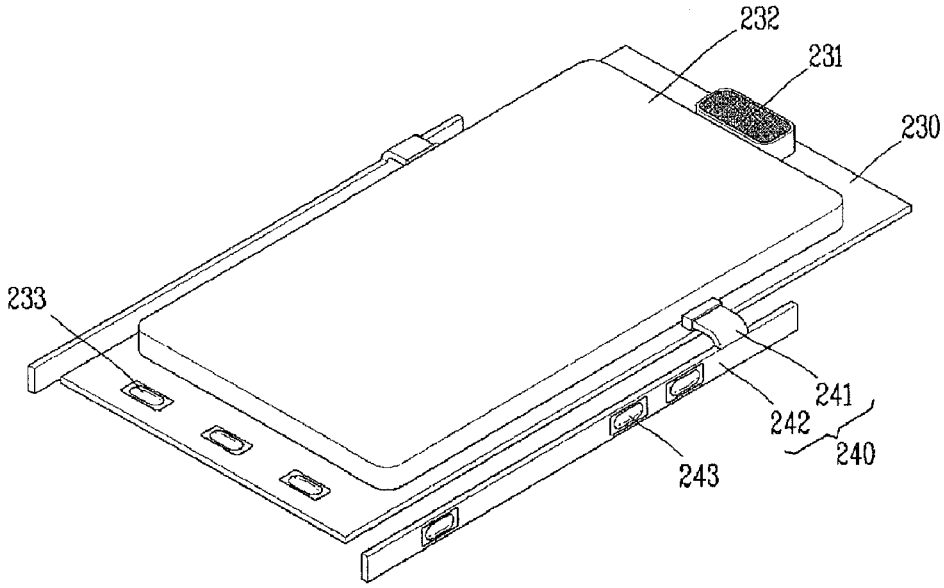
FIG. 7 is a perspective view showing a printed circuit board having an electric field reducing unit according to an example embodiment of the present invention.

FIG. 7 is a perspective view showing a printed circuit board having an electric field reducing unit according to an example embodiment of the present invention. Other embodiments and configurations are also within the scope of the present invention.

A printed circuit board 230 may have a same configuration as the previous embodiment, other than the printed circuit board 230 may be coupled to an electric field reducing unit 240 rather than the electric field reducing unit 140. The electric field reducing unit 240 may also be referred to as a ground unit.

The electric field reducing unit 240 may include a connecting portion 241 and an extending portion 242. The connecting portion 241 and the extending portion 242 of the electric field reducing unit 240 may be implemented as a Flexible Printed Circuit Board (FPCB) 241 and a key plate 242, respectively.

The key plate 242 may be formed of a conductive material (e.g., a metallic material) in a plate shape, and a switch 243 (or button) may enable an inputting of information by a push operation. The switch 243 may be mounted on the key plate 242. A plurality of switch (or buttons) 243 may be provided on the key plate 242, and may also be implemented as the second manipulation unit 117.

The FPCB 241 may electrically connect a ground unit including the key plate 242 and the printed circuit board 230, and partially transfer a current on the printed circuit board 230 to the key plate 242. The total length of the key plate 242 and the FPCB 241 may have a length corresponding to ¼ times of the antenna wavelength λ.

FIG. 7 also shows a receiver 231, a display module 232 and a switch 233, which may correspond to the receiver 131, the display module 132 and the switch 133 shown in FIG. 4.

The electric field reducing unit 240 may have a structure capable of implementing the second manipulation unit 117 and reducing a transfer amount of current at the periphery of the receiver 231.

FIG. 8 is a block diagram showing a portable terminal according to an example embodiment of the present invention. Other embodiments and configurations are also within the scope of the present invention.

As shown in FIG. 8, the portable terminal may include a wireless communication module 161, the manipulation units 116 and 117, the image input units 115 and 120, the audio input unit 118, the display 113, the audio output units 114 and 123, a sensing unit 166, the interface 119, a broadcast receiving module 165, a memory 164, the power supply 125 and a controller 160.

The controller 160 may control general operations of the portable terminal. For example, the controller 160 may perform controlling and processing associated with voice calls, data communications, video calls, and the like.

The wireless communication module 161 may include one or more components that permit wireless communication between the portable terminal and a wireless communication system or a network within which the portable terminal is located. The wireless communication module 161 may perform transmission/reception of voice data, text data, image data and control data under control of the controller 160. The wireless communication module 161 may include a transmitter 163 for modulating a signal to be transmitted and a receiver 162 for demodulating a received signal.

The manipulation units 116 and 117 may generate key input data inputted by a user to control various operations of the portable terminal 100.

The image input units 115 and 120 may process image frames of still pictures or videos obtained by an image capture device (image sensor) in a video call mode or an image capturing mode. The processed image frames may be displayed on the display 113.

The image frames processed by the image input units 115 and 120 may be stored in the memory 164 or may be transmitted via the wireless communication module 161 under control of the controller 160.

The audio input unit 118 may receive an external audio signal through a microphone while the portable device is in a particular mode, such as a phone call mode, a recording mode and a voice recognition mode, and process it into digital data. The processed audio (voice) data may be converted for output into a format transmittable to a mobile communication base station via the wireless communication module 161 in case of the phone call mode. In the recording mode, the processed audio data may be stored in the memory 164.

The audio input unit 118 may include various types of noise canceling (or suppression) algorithms to cancel (or suppress) noise generated in the course of receiving and transmitting audio signals.

The display 113 may visually display information associated with the portable terminal. For example, if the portable terminal is operating in a phone call mode, the display 113 may provide a user interface (UI) or a graphical user interface (GUI) that includes information associated with placing, conducting, and terminating a phone call. As another example, if the portable terminal is in a video call mode or an image capturing mode, the display 113 may additionally or alternatively display images that are associated with these modes, or the UI and the GUI.

The audio output units 114 and 123 may output audio data received from the wireless communication module 161 or stored in the memory 164, under control of the controller 160, in a call signal reception mode, a call mode, a recording mode, a voice recognition mode, a broadcast reception mode, and the like.

In addition, the audio output units 114 and 131 may provide audible outputs related to a particular function (e.g., a call signal reception sound, a message reception sound, etc.) performed by the portable terminal. The audio output units 114 and 131 may include a speaker, a receiver, a buzzer, or the like.

The sensing unit 166 may detect a current status (or state) of the portable terminal such as an opened/closed state of the portable terminal, a location of the portable terminal, a presence or absence of user contact with the portable terminal, etc., and generate commands or signals for controlling operation of the portable terminal. For example, the sensing unit 166 may detect whether or not the power supply 125 supplies power or whether or not the interface 119 is coupled with an external device.

The interface 119 may serve as an interface with at least one external device connected with the portable terminal. For example, the external devices may include wired/wireless headset ports, external power charger ports, wired/wireless data ports, card sockets, e.g., memory card ports, SIM/UIM cards, among others. The interface 119 may receive inputs (e.g., data, information, power, etc.) from an external device and transfer the received inputs to one or more elements within the portable terminal or may transfer data from the portable terminal to an external device.

The memory 164 may store software programs or the like used for the processing and controlling performed by the controller 160, or may temporarily store inputted/outputted data (e.g., a phonebook, messages, still images, video, etc.).

The memory 164 may store software programs for controlling general operations of the portable terminal.

The memory 164 may include at least one type of storage medium including a hard disk type, a card-type memory (e.g., SD or XD memory, etc), a Random Access Memory (RAM), a Read-Only Memory (ROM), a flash memory, and the like.

The broadcast receiving module 165 may receive a broadcast signal and/or broadcast associated information from an external broadcast managing server via a broadcast channel. The broadcast channel may include a satellite channel and a terrestrial channel. The broadcast receiving module 165 may convert the received broadcast signal into a form of broadcast data capable of being outputted to the audio output units 114 and 123 and the display 113, and then output the same to the controller 160. The broadcast receiving module 165 may receive broadcast associated additional data (e.g., an electronic program guide (EPG), a channel list, etc.). The broadcast data and the additional data converted by the broadcast receiving module 165 may be stored in the memory 164.

The power supply 125 may provide power used by various components for the portable device. The provided power may be internal power, external power, or combinations thereof.

A portable terminal may include a terminal body having a receiver at one end thereof, a ground unit connected to an antenna mounted at the terminal body, and an electric field reducing unit connected to the ground unit to partially transfer a current flowing in the ground unit to a side surface of the terminal body so as to reduce strength of an electric field formed at a periphery of the receiver.

The antenna may include an internal antenna mounted at another end of the terminal body.

The ground unit may be implemented as a printed circuit board within the terminal body.

The electric field reducing unit may be a branch type that extends from a side surface of the printed circuit board and that extends in a direction away from the receiver (i.e., an opposite direction).

The electric field reducing unit may include a connecting portion to connect to the side surface of the printed circuit board at a location spaced a certain distance from the receiver, and an extending portion to extend from the connecting portion in a direction away (or in an opposite direction) from the receiver.

The antenna may transmit and receive an electric wave having a certain wavelength, and the electric field reducing unit may have a length corresponding to ¼ times of the wavelength.

Embodiments of the present invention may include an electric field reducing unit for partially transferring current flowing on a ground unit to a side surface of the terminal body, thereby reducing strength of the electric field formed at a periphery of the receiver, thus minimizing interference between the portable terminal and the hearing aid.

The electric field reducing unit may have a length corresponding to ¼ times of the wavelength of the electric wave in which an antenna transmits and receives, thereby maximizing an amount of current to be transferred to the electric field reducing unit.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A portable terminal comprising:

a terminal body having a receiver at a first end of the terminal body;

a display located on a surface of the terminal body;

a printed circuit board having a ground unit coupled to an antenna disposed at a second end of the terminal body, wherein a portion of the printed circuit board is overlapped by the display; and an electric field reducing unit to couple to the ground unit, to transfer a current flowing in the ground unit to a side of the terminal body and to reduce strength of an electric field formed at the receiver, wherein the electric field reducing unit comprises:

a connecting portion configured to couple to a side of the printed circuit board, and an extending portion formed at the side of the printed circuit board with a predetermined distance therebetween, the extending portion to extend from the connecting portion in a direction away from the receiver.

2. The portable terminal of claim 1, wherein the antenna comprises an internal antenna mounted at the second end of the terminal body.

3. The portable terminal of claim 1, wherein the extending portion is formed in a lengthwise direction parallel to the printed circuit board.

4. The portable terminal of claim 1, wherein the connecting portion is a Flexible Printed Circuit Board (FPCB), and the extending portion is a key plate that includes a switch to enable inputting of information by a push operation.

5. The portable terminal of claim 1, wherein the antenna to transmit and receive an electric wave having a prescribed wavelength, and the electric field reducing unit has a length corresponding to ¼times of the prescribed wavelength.

6. The portable terminal of claim 1, wherein the extending portion longitudinally extends from the connection portion and such that the predetermined distance is between the extending portion and the side of terminal body.

7. A portable terminal comprising:

an antenna to receive a signal;

a receiver to output an audio sound based on the received signal;

a terminal body to support the receiver disposed at a first end of the terminal body and the antenna disposed at a second end of the terminal body, the terminal body having a side that extends in a longitudinal direction;

a circuit board to couple to the antenna and to the receiver, wherein at least a portion of the circuit board is overlapped by a display provided on a surface of the terminal body; and an electric field reducing unit to couple to the circuit board, and to receive current from the circuit board, wherein the electric field reducing unit includes:

a first portion to couple to the circuit board; and a second portion formed at the side of the printed circuit board with a predetermined distance therebetween, the second portion to extend from the first portion in the longitudinal direction along the side of the terminal body.

8. The portable terminal of claim 7, wherein the electric field reducing unit receives the current from the circuit board and reduces an electric field strength about the receiver.

9. The portable terminal of claim 7, wherein the second portion is formed in a lengthwise direction parallel to the circuit board.

10. The portable terminal of claim 7, wherein the first portion is a Flexible Printed Circuit Board (FPCB), and the second portion is a key plate that includes a switch to enable inputting of information by a push operation.

11. The portable terminal of claim 7, wherein the antenna to transmit and receive an electric wave at a prescribed wavelength, and the second portion of the electric field reducing unit has a length corresponding to ¼times of the prescribed wavelength.

* * * * *